US009827165B1

(12) United States Patent
Sundt

(10) Patent No.: US 9,827,165 B1
(45) Date of Patent: Nov. 28, 2017

(54) MULTIPLE PILL OR TABLET SPLITTER

(71) Applicant: Peter Christian Sundt, Houston, TX (US)

(72) Inventor: Peter Christian Sundt, Houston, TX (US)

(73) Assignee: CIBOLD PRESS, LLC, Houston, TX (US)

( * ) Notice: Subject to any disclaimer, the term of this patent is extended or adjusted under 35 U.S.C. 154(b) by 61 days.

(21) Appl. No.: 14/925,972

(22) Filed: Oct. 28, 2015

Related U.S. Application Data

(60) Provisional application No. 62/069,317, filed on Oct. 28, 2014.

(51) Int. Cl.
*B25F 3/00* (2006.01)
*A61J 7/00* (2006.01)

(52) U.S. Cl.
CPC ..... *A61J 7/0007* (2013.01)

(58) Field of Classification Search
CPC ..... A61J 7/0007
USPC ..... 225/105, 93, 97
See application file for complete search history.

(56) References Cited

U.S. PATENT DOCUMENTS 6,527,155 B2 * 3/2003 Buckley ..... A61J 7/0007 225/1
6,557,945 B1 * 5/2003 Eric ..... A61J 7/0007 30/124
7,673,778 B2 * 3/2010 Sze ..... A61J 7/0007 225/103
8,590,164 B2 * 11/2013 Noble ..... A61J 7/0007 225/104
9,314,405 B2 * 4/2016 Smith ..... A61J 7/0007
2015/0164747 A1 * 6/2015 Li ..... A61J 1/03 30/124
2016/0051448 A1 * 2/2016 Ferraro ..... A61J 7/0007 83/468.7

* cited by examiner

*Primary Examiner* — Omar Flores Sanchez
(74) *Attorney, Agent, or Firm* — Kenneth A. Roddy

(57) ABSTRACT

A manually operated multiple pill or tablet splitter for simultaneously cutting or splitting a plurality of pills in a single operation is disclosed. The device includes a base member that provides a flat top surface for loading the pills, spring loaded alignment bars for containing, aligning, and holding the pills or tablets in a straight line, and a close fitting cover member having a cutting blade fitted inside which is surrounded by a retractable spring biased blade guard to cover the blade prevent injury. When the cover is manually pushed down onto the base member, the blade guard is retracted and the cutting blade bisects all the pills or tablets in a single operation.

4 Claims, 8 Drawing Sheets

MULTIPLE PILL OR TABLET SPLITTER

CROSS REFERENCE TO RELATED APPLICATION

This application claims priority of U.S. Provisional Application Ser. No. 62/069,317, filed Oct. 28, 2014.

BACKGROUND OF THE INVENTION

1. Field of the Invention

This invention relates generally to manually operated pill or tablet cutter and splitter devices and, more particularly, to a manually operated multiple pill or tablet splitter for simultaneously cutting or splitting a plurality of pills in a single operation.

2. Background Art

Use of medications for chronic illnesses, such as hypertension, diabetes, or high cholesterol (all common U.S. conditions) can often run into the thousands of dollars per year. Cutting or splitting pills and tablets in half is a practice that many patients, employers, healthcare providers, and even health insurance and managed care companies are now recommending. For example, United Healthcare has instituted the "Half Tablet Program" to guide their members into cost-savings.

Splitting or cutting a large quantity of pills in half, using conventional commercially available single pill cutters, is time consuming and tedious. Most currently available multiple pill splitters or cutters are expensive, high thru-put devices used by professionals.

There are several patents directed manually operated pill or tablet cutter and splitter devices of various construction. The following are several examples of such devices.

Buckley, U.S. Pat. No. 6,527,155, discloses a manually operable tablet splitting apparatus, including a base having a frame mounted on an upper surface thereof and a disposable tablet-receiving tray, including a plurality of tablet shaped cavities for receiving and holding the tablets in position to be split. A handle is pivotally attached to the base and is movable between a tablet loading position and a tablet splitting position. The handle includes a blade for splitting the tablets into two substantially equal parts. A retractable shield is provided for covering the blade while it is in the tablet loading position, thereby reducing the likelihood of injury to an operator during operation of the apparatus. Each one of the tray cavities is adapted for receiving a tablet and for holding the received tablet in position for splitting.

Eric, U.S. Pat. No. 6,557,945, discloses a tablet cutter including a tablet supporting assembly and a tablet cutting assembly secured to the tablet supporting assembly and which includes a blade holder which is movable by the action of a cam follower on an axially extending arm of the blade holder to provide accurate and safe cutting of tablets in which the tablet cutter can accommodate a wide variety of shapes and sizes of tablets.

Sharpe, U.S. Pat. No. 6,739,488, discloses a tablet cutter having a blade support portion, a cutting blade, and a tablet support portion. The blade support portion has a hollow rectangular box shape portion with five sides and one open end. The cutting blade is affixed to the interior of the blade support portion. The tablet support portion has at least one tablet holder. The blade support portion may be adapted to enclose the tablet support portion as the tablet support portion slidably engages the blade support portion.

Darst, U.S. Pat. No. 7,243,826, discloses a pill box having a base, a lid with a blade, and a blade guard. The base has a bottom side to which the blade guard is coupled. The base also has a top side with a pill storage compartment, a pill cutting surface, and a pill grip coupled to the pill cutting surface. The lid has a top side and a bottom side with the bottom side having a blade coupled to it. The lid is coupled to the base by one or more hinges.

Engel, et al, U.S. Pat. No. 7,252,254, discloses a pill or tablet crusher and splitter using a combination lever and screw action. A lever attached to a ring having an internal screw thread advances a transversely movable platen towards a transversely fixed or placed anvil crushing a pill or tablet placed between the platen and anvil. The anvil may be removable for easy cleaning. A pill or tablet splitter may be placed in a sunken area beneath an intermediate portion of the lever. The pill or tablet splitter has a tray with a plurality of sloped bottom V-shaped pill or tablet holding clamps. A blade attached to a cover-cutter is placed over the tray. The cover-cutter is forced downward by the movement of the lever splitting or cutting the pills or tablets.

Sze, U.S. Pat. No. 8,474,674, discloses a pill cutter that has a protected cutting edge. The pill cutter includes a guard, a base, and a cover. The components are arranged such that the guard slides over the cutting edge when the pill cutter is in an open position and the guard exposes the cutting edge when the pill cutter is in a closed position. Sze, U.S. Pat. No. 8,430,287, discloses a method for assembling the pill cutter and a method of using the pill cutter to cut a pill or tablet.

Raghuprasad, U.S. Pat. No. 8,550,319, discloses a multi-tablet cutting device having a removable tablet holding tray, a housing structure and a plurality of vertically movable cutting blades. The removable tablet holding tray has a plurality of tablet nests. Each nest has two or more levels of beds sized to hold tablets of different sizes or shapes. The housing structure has at least one opening to receive the removable tablet holding tray. The plurality of vertically movable cutting blades is mounted on a support structure on the inside of the housing above the tablet holding tray above a location where the tablet holding tray is stored. The plurality of cutting blades is aligned above the tablet nests and upon a downwardly directed vertical movement the plurality of cutting blades passes through first slots in the nests aligned with the cutting blades to cut the tablets held in the nests into halves.

Noble, et al, U.S. Pat. No. 8,590,164, discloses a pill splitter that includes a base, a cover pivotably secured to the base, a cutting blade attached to the cover, and a pill holder arrangement. The pill holder arrangement includes a slideable fixture constructed and arranged to be movable relative to the base and hold the pill. The pill holder arrangement allows a pill to split when the cover is moved in a closed position.

Young, et al, U.S. Pat. No. 8,720,808, discloses systems and methods for preparation of medications wherein a pill is divided using a pill splitter and crusher device having a first member coupled to a second member. The first member comprises a pill-receiving cavity and the second member comprises a blade and an anvil. In some embodiments, the anvil is configured to crush a pill placed within the cavity and the blade is configured to split the pill within the cavity. Furthermore, the anvil is coupled to the second member, such that the anvil could move from a crushing position to a non-crushing position, which allows for crushing and splitting of the pill, respectively.

SUMMARY OF THE INVENTION

The present invention overcomes the aforementioned problems and is distinguished over the prior art in general, and these patents in particular, by a manually operated multiple pill or tablet splitter for simultaneously cutting or splitting a plurality of pills in a single operation. The device includes a base member that that provides a flat top surface for loading the pills, spring loaded alignment bars for containing, aligning, and holding the pills or tablets in a straight line, and a close fitting cover member having a cutting blade fitted inside which is surrounded by a retractable spring biased blade guard to cover the blade and prevent injury. When the cover is manually pushed down onto the base member, the blade guard is retracted and the cutting blade bisects all the pills or tablets in a single operation.

One of the significant features and advantages of the present invention is that it will bisect a plurality of circular or oval shaped pills or tablets in a single operation.

Another feature and advantage of the multiple pill splitter is that it is safe, rugged, and reliable in operation.

Another feature and advantage of the multiple pill splitter is that it is simple in design and inexpensive to manufacture Other features and advantages of the invention will become apparent from time to time throughout the specification as hereinafter related.

DETAILED DESCRIPTION OF THE INVENTION

Figure 1:
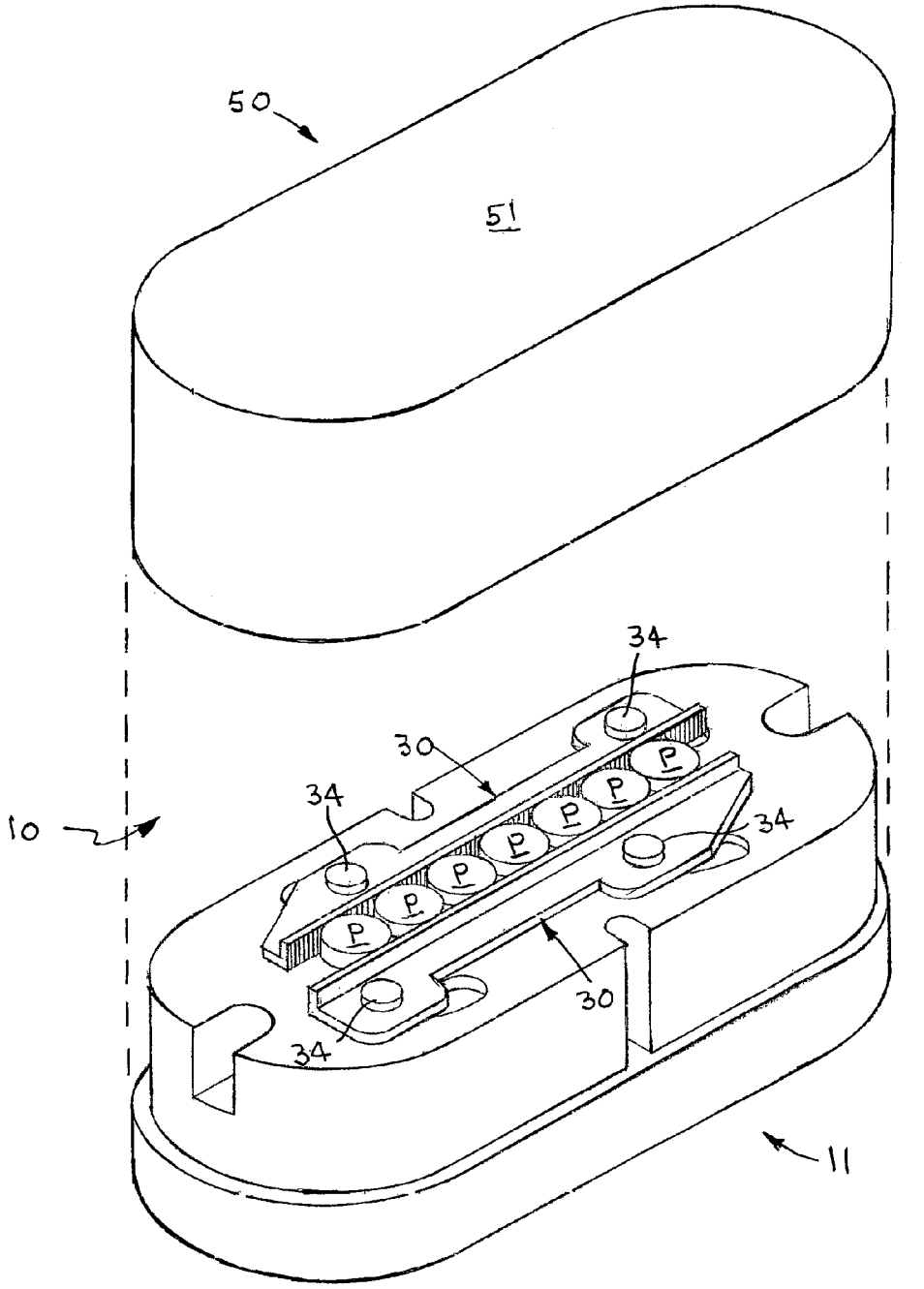
FIG. 1 is an exploded perspective view of the multiple pill or tablet splitter device in accordance with the present invention, shown with the cover member removed and the base member in an assembled condition with the spring loaded alignment bars holding a plurality of pills or tablets in a straight line on the top surface of the base member.

Referring to the drawings by numerals of reference, there is shown in FIG. 1, a multiple pill or tablet splitter device 10 in accordance with the present invention. The major components of the pill or tablet splitter device 10 include a base member 11 and a cover member 50, shown with the cover member removed. As described hereinafter, the pill or tablet splitter device 10 includes a pair of spring loaded alignment bars 30 movably mounted on the top surface of the base member 11 that hold a plurality of pills or tablets P in a straight line on the top surface of the base member, as shown in FIG. 1.

Referring additionally to FIGS. 2-6, the base member 11 is a hollow generally rectangular member having a top end wall 12, an open bottom end, and longitudinally opposed rounded ends. The base member 11 has a wider and longer lower portion 13 of substantially the same profile that extends upwardly a distance from the open bottom end and terminates in a peripheral shoulder 14. A pair of tubular posts 15 extend downward a distance from the underside of the top end wall of the base member 11 in longitudinally spaced relation, and a pair of diametrically opposed arcuate slots 16 extend through the top end wall 12 equidistant from each post.

A rotor 20 is rotatably mounted on each tubular post 15 on the underside of the top end wall of the base member 11. Each rotor 20 has a flat disk-shaped main body portion 21, a central tubular member 22 extending downwardly from the underside thereof with a central bore 23 extending through central tubular member and the main body of the rotor. A pair of diametrically opposed smaller diameter tubular upper posts 24 extend upwardly a distance from the top surface of the main body 21 of each rotor 20 equidistant from the central bore 23 of the rotor. The central tubular member 22 of each rotor 20 is rotatably received on a respective tubular post 15 on the underside of the top end wall of the base member 11, and the two smaller diameter tubular upper posts 24 of each rotor are slidably received through the respective diametrically opposed arcuate slots 16 extending through the top end wall of the base member 11. A smaller diameter tubular lower post 25 extends downwardly a distance from the bottom surface of the main body of each rotor 20 radially spaced from the central bore of the rotor. Each of the smaller diameter tubular upper and lower posts 24 and 25 has a central bore.

Figure 2:
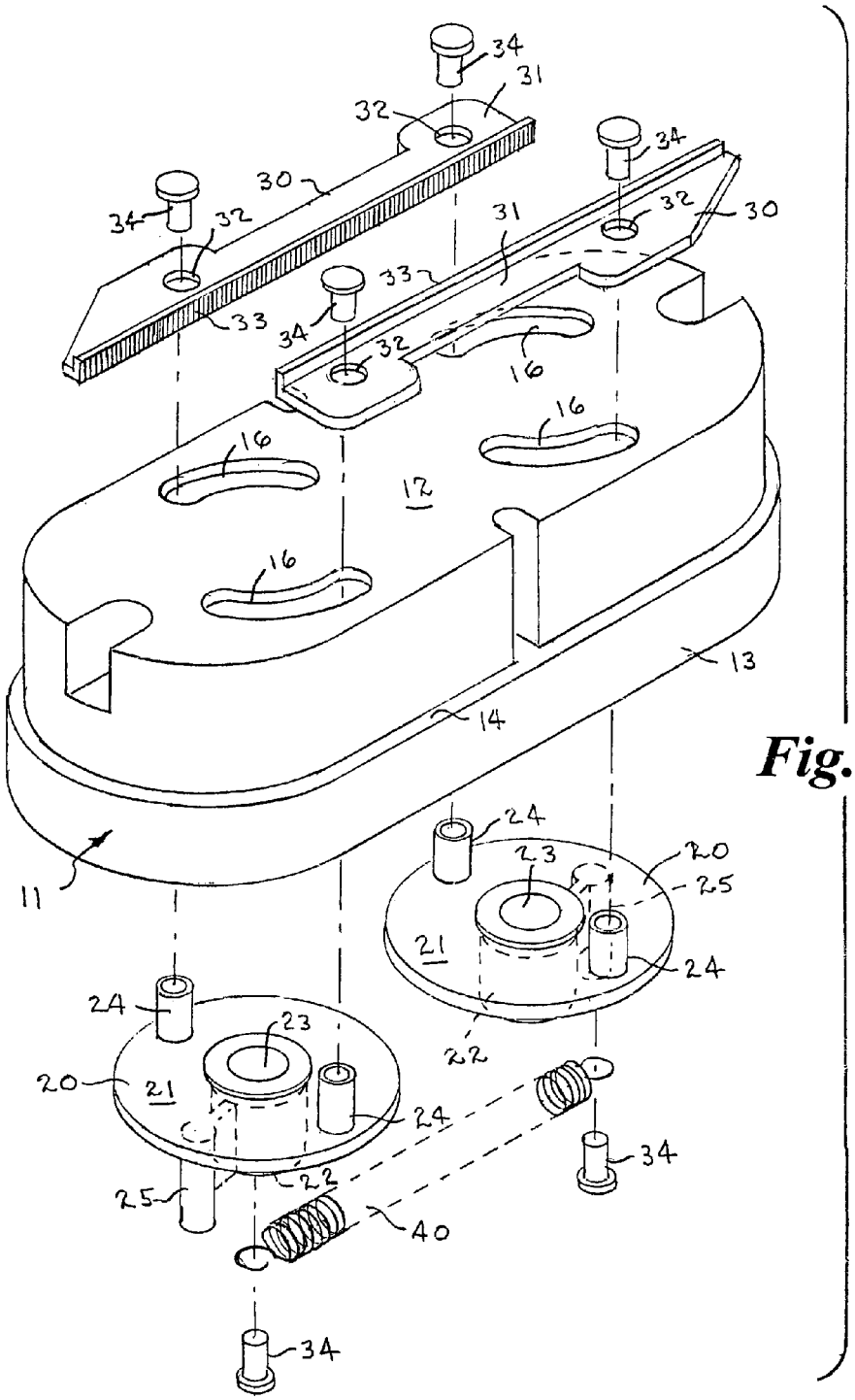
FIG. 2 is an exploded perspective of the base member, shown with the components in an unassembled condition.
Figure 3:
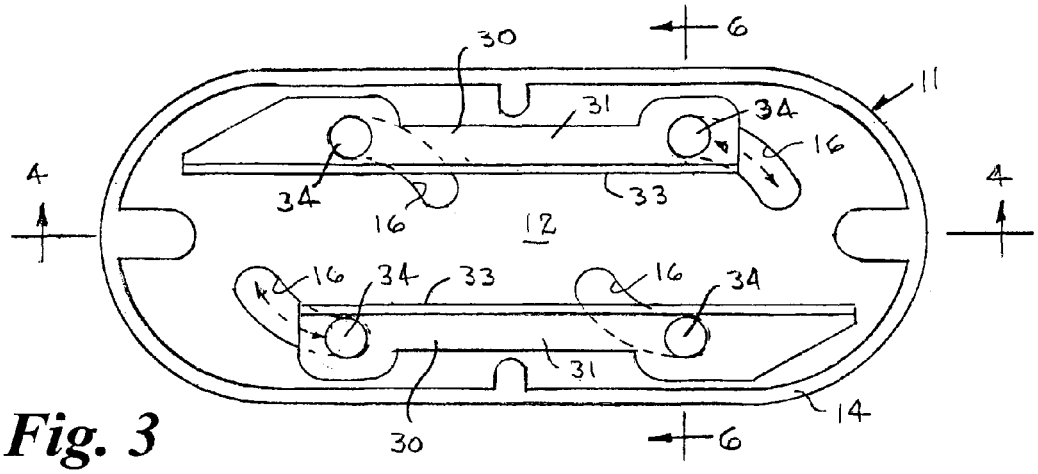
FIG. 3 is top plan view of the base member, shown with the alignment bars in a fully open position.
Figure 4:
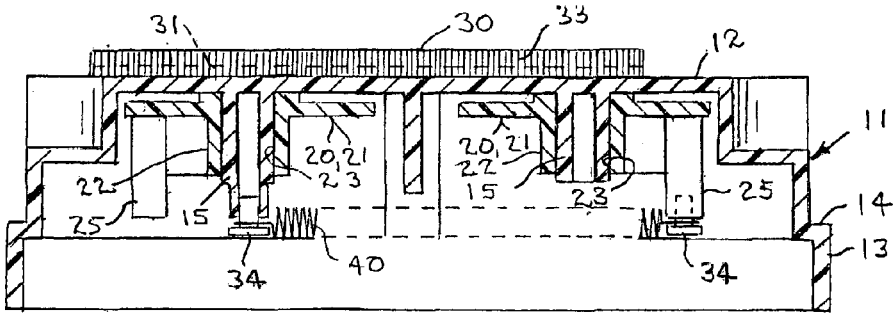
FIG. 4 is longitudinal cross section view of the base member assembly, taken along line 4-4 of FIG. 3.
Figure 5:
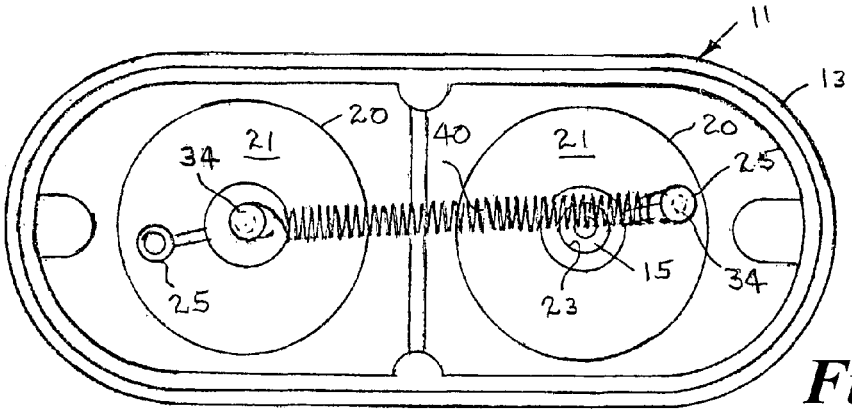
FIG. 5 is bottom plan view of the base member assembly, shown with the rotor members connected by the tension spring and rotated to place the alignment bars in the fully open position.
Figure 6:
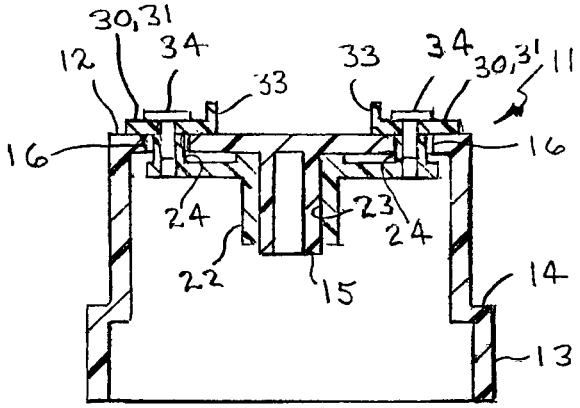
FIG. 6 is transverse cross section view of the base member assembly, taken along line 6-6 of FIG. 3, shown with the alignment bars in the fully open position.
Figure 7:
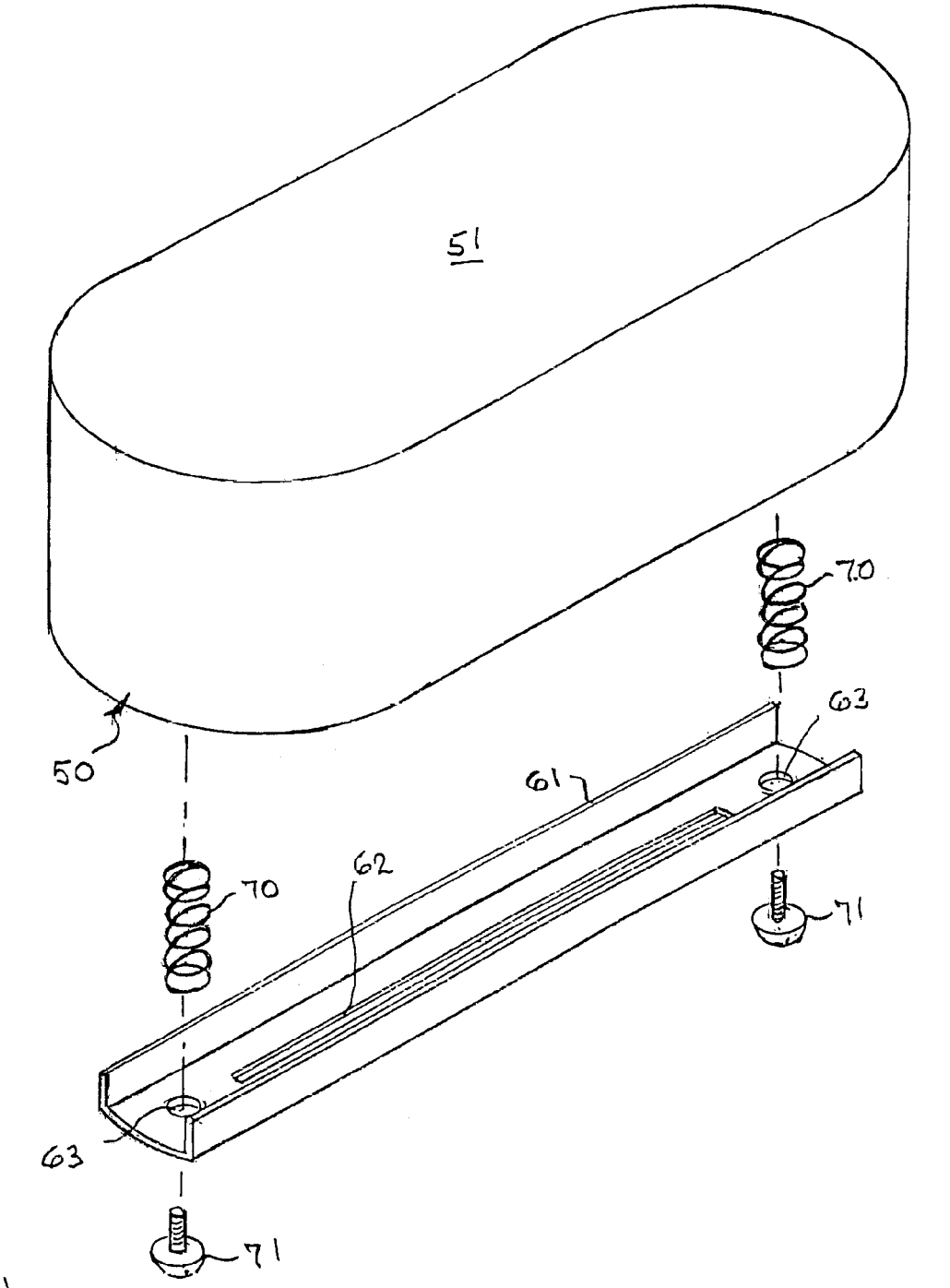
FIG. 7 is an exploded perspective of the cover member, shown with the components in an unassembled condition.
Figure 8:
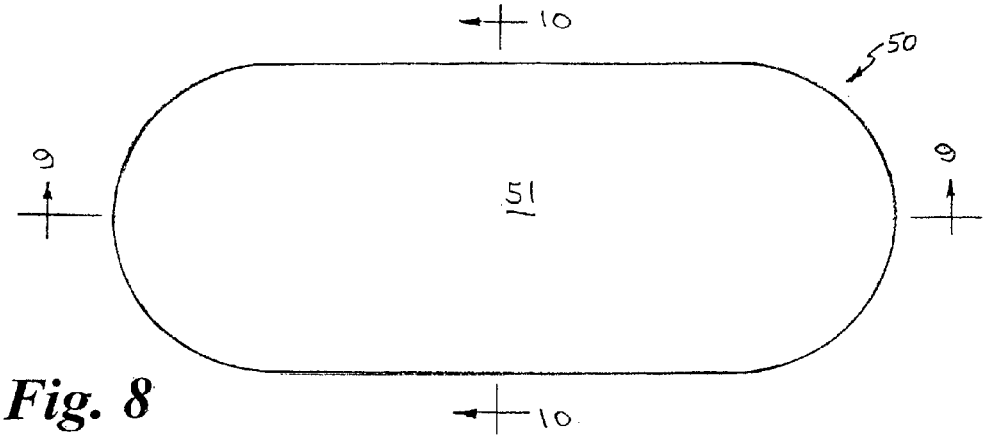
FIG. 8 is top plan view of the cover member.
Figure 9:
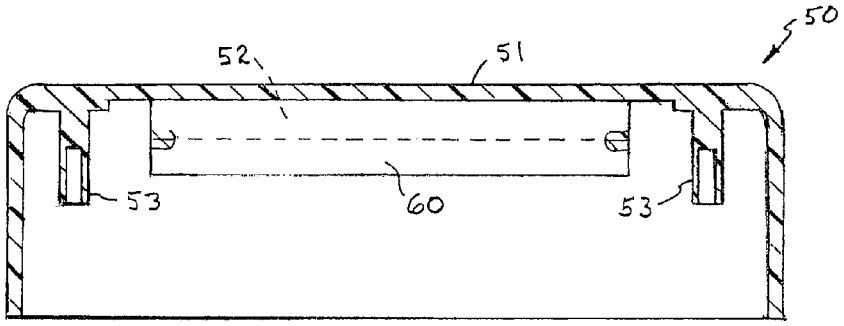
FIG. 9 is longitudinal cross section view of the cover member, taken along line 9-9 of FIG. 8.
Figure 10:
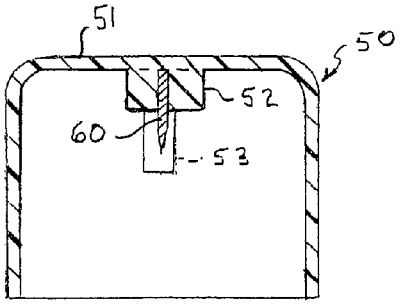
FIG. 10 is transverse cross section view of the cover member, taken along line 10-10 of FIG. 9.
Figure 11:
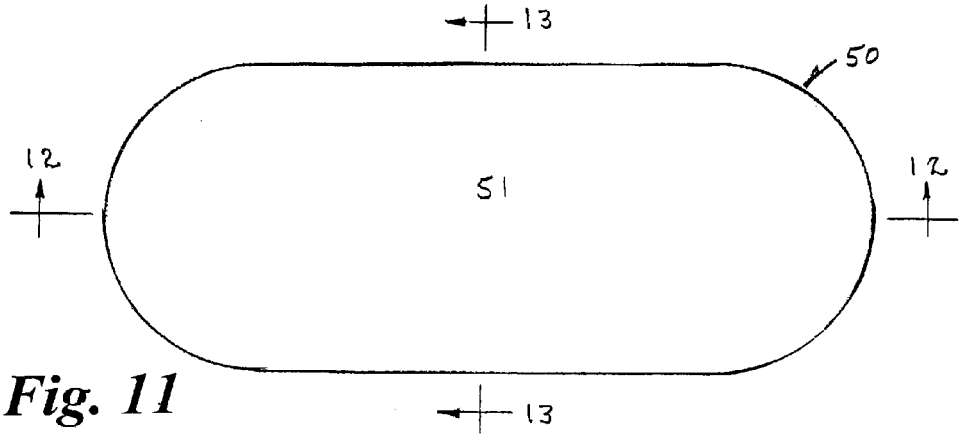
FIG. 11 is top plan view of the cover member assembly.
Figure 12:
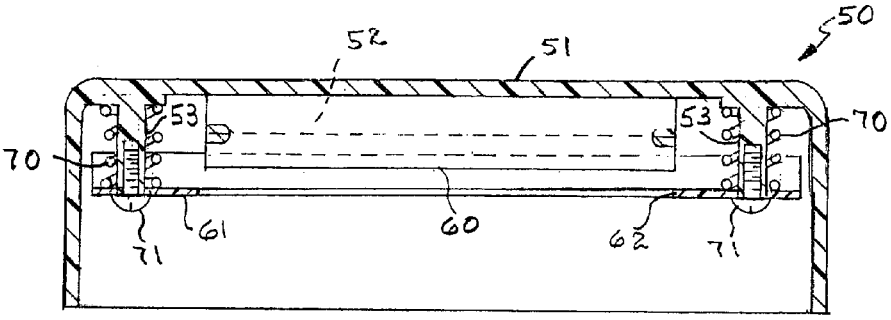
FIG. 12 is longitudinal cross section view of the cover member assembly, taken along line 12-12 of FIG. 11, shown with the blade guard biased downward from the cutting blade by the compression springs.
Figure 13:
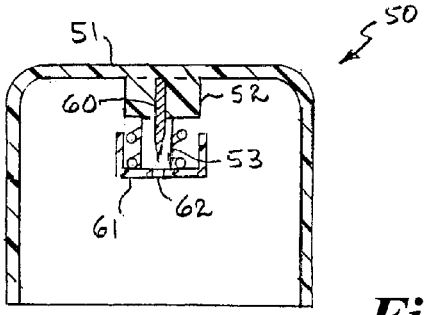
FIG. 13 is transverse cross section view of the cover member assembly, taken along line 13-13 of FIG. 11, shown with the blade guard biased downward from the cutting blade by the compression springs.

As discussed briefly above, a pair of alignment bars 30 are used to hold a plurality of pills or tablets P in a straight line on the top surface of the base member 11. As best seen in FIGS. 2, 3, and 6, each alignment bar 30 is an elongate member having a generally L-shaped transverse cross section with a wider longitudinal leg 31 having a pair of holes 32 therethrough in longitudinally spaced relation, and an upstanding shorter longitudinal leg 33 having a knurled outer surface. The holes 32 through each wider longitudinal leg are received on two of the smaller diameter tubular upper posts 24 of each rotor 20 that extend through the respective diametrically opposed arcuate slots 16 in the top end wall 12 of the base member 11. As best seen in FIGS. 1, 2, and 6, the alignment bars 30 are retained on the tubular upper posts by a headed pin 34 whose shank is pressed into the central bore of the upper posts of each rotor 20. The knurled surface of the laterally opposed upstanding shorter longitudinal legs of the alignment bars 30 aid in gripping and preventing the aligned pills or tablets P from slipping.

Referring again to FIGS. 2, 4, and 5, a tension spring 40 has one end connected to one tubular post 15 on the underside of the top end wall of the base member 11 by a headed pin 34 whose shank is pressed into the central bore of the tubular post. The opposed end of the tension spring 40 is connected to the smaller diameter tubular lower post 25 that extends a distance from the bottom surface of the main body of the other rotor by a headed pin 34 whose shank is pressed into the central bore of the smaller diameter lower tubular post. Thus, the tension force of the spring 40 acts to pull the alignment bars 30 toward the centerline of the base member 11. The alignment bars 30 always remain parallel to each other and equidistant from the centerline of the base member 11.

Referring now to FIGS. 7-13, the cover member 50 is a hollow generally rectangular member having a top end wall 51, an open bottom end, and longitudinally opposed rounded ends. The cover member 50 is configured to be removably and slidably received on the upper portion of the base member 11 above the peripheral shoulder 14. A central generally rectangular cutting blade support 52 formed on the underside of the top end wall 51 of the cover member 50 along the centerline thereof extends downwardly a distance therefrom, and a pair of tubular posts 53, each disposed a distance outwardly from the respective opposed ends thereof, extend downward a distance from the underside of the top end wall of the cover member and a distance beyond the blade support 52. A cutting blade 60 is secured in the blade support 52 and its cutting edge extends a short distance downwardly therefrom. In a preferred embodiment, but not limited thereto, the cutting blade 60 is secured in the blade support 52 during a molding operation. Each of the tubular posts on the underside of the cover member 50 has a central bore. A compression spring is received on the exterior of each of the tubular posts on the underside of the cover member 50.

A longitudinal blade guard 61 (FIGS. 7, 12, and 13) having a generally U-shaped transverse cross section and a central longitudinal slot 62 extending along the center thereof retractably covers the exposed cutting edge of the cutting blade 60. The blade guard 61 has a pair of holes 63 therethrough disposed a distance outwardly from the central longitudinal slot 62 near respective opposed ends thereof. The blade guard 61 is supported on the outer end of the compression springs 70 and retained by a pair of headed screws having their shanks passing through the holes at the opposed ends thereof. Thus, the compression springs retractably support the blade guard 61 a distance from the cutting blade 60.

OPERATION

Figure 14:
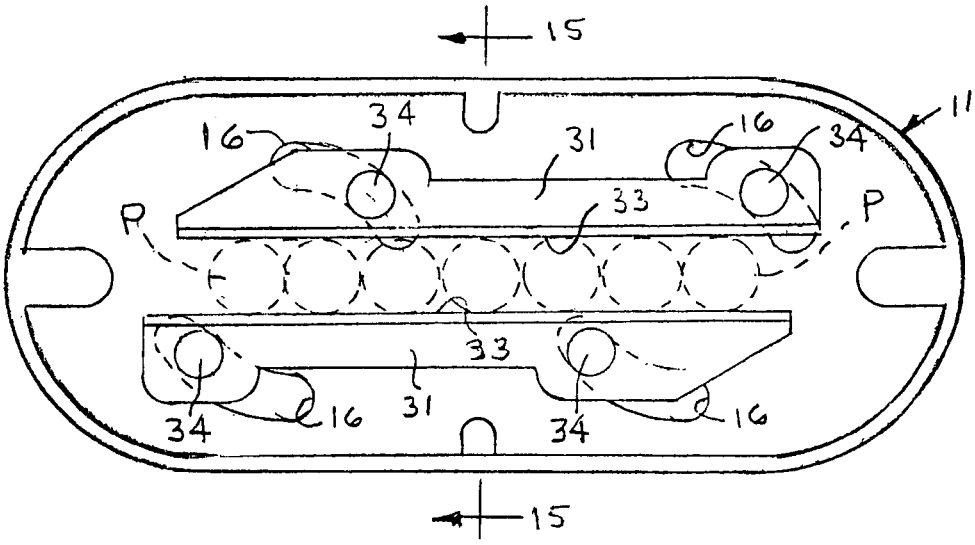
FIG. 14 is top plan view of the base member assembly, shown with the alignment bars moved to grip and align a plurality of pills or tablets.
Figure 15:
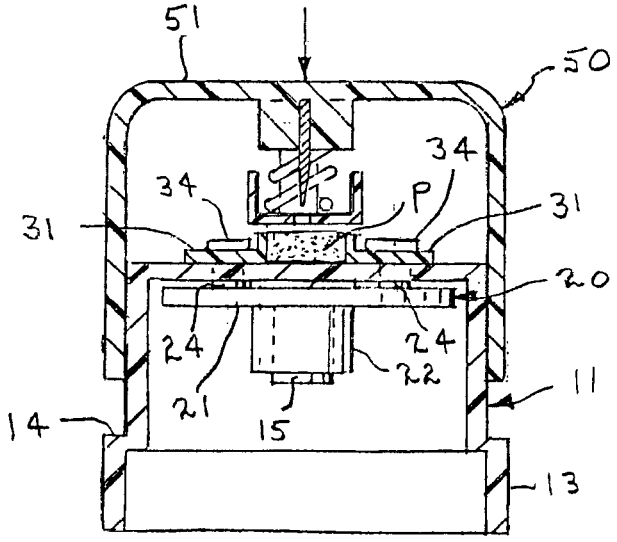
FIG. 15 is transverse cross section view of the base member assembly griping a row of pills or tablets, taken along line 15-15 of FIG. 14, and the cover member assembly received on the base member assembly being pressed downward to split the pills or tablets.

As shown in FIGS. 14 and 15, in operation, the cover member 50 is removed, the alignment bars 30 are manually spread open with the user's fingers, and the pills or tablets P to be split are placed onto the top surface of the base member 11 in a row. Oblong pills can be accommodated by loading them so that the long axes of the pills are perpendicular to the cutting blade. The spring biased alignment bars 30 are then allowed to close onto the outside diameter or the outer ends of the pills or tablets P, thus aligning them in a straight line directly on the centerline of the base member 11. The knurled surfaces of the laterally opposed upstanding shorter longitudinal legs 33 of the alignment bars 30 aid in gripping and preventing the aligned pills or tablets P from slipping. The cover member 50, with its interior cutting blade 60, is then placed over the upper portion of the base member 11 such that the retractable spring biased blade guard 61 is in contact with the row of pills or tablets P, thereby holding them in place, and the cover member 50 is supported by gravity by the blade guard and its associated springs.

Then, the cover member 50 is manually pushed down against the spring bias of the compression springs 70 such that the retractable spring biased blade guard 61 is retracted and the cutting blade 60 extends through the slot 62 in the blade guard 61 and bisects all of the pills or tablets P in a single operation. As the cutting blade 60 bisects the pills or tablets, the alignment bars 30 move laterally apart under the force of the tension spring 40 to allow the cutting blade to pass through without crushing the pills or tablets. As the cover member 50 comes to rest on the peripheral shoulder 14 of the base member 11, the cutting blade edge comes to rest a short distance from the top surface of the base member, thus preventing the cutting blade 60 from cutting into the top surface of the base member. The cover member 11 is then removed, the alignment bars 30 are spread apart, and the pill halves are cleared away. When the cover member 50 is removed, the cutting blade is surrounded by the retractable blade guard 61 to cover the blade and prevent injury.

The pill or tablet capacity of the device is determined by the length of the alignment bars 30 and the diameter or outer periphery of the pills. In the illustrated example of the present invention, the device will accommodate up to fifteen 5 mm diameter pills and up to five 15 mm diameter pills.

It should be understood that the present device can be used to bisect any object that will fit within the range of the alignment bars, so long as the material can be cut with hand pressure, including disks, rectangles, and other polygons. The requirement is that on each pass all of the objects must be the same size.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A manually operated multiple pill or tablet splitter for simultaneously cutting or splitting a plurality of pills in a single operation, comprising:

a hollow generally rectangular base member having an upper portion with a flat top end wall for receiving and supporting a plurality of pills or tablets, opposed longitudinal side walls and longitudinally opposed rounded ends, and a contiguous lower portion with an open bottom end surrounded by a wider and longer side wall of substantially the same configuration extending upwardly a distance from said open bottom end and terminating in a peripheral shoulder adjoining said upper portion;

a pair of elongate longitudinal spring biased alignment bars movably mounted on said base member flat top end wall, and each having a generally L-shaped transverse cross section with a horizontal leg and a straight upstanding vertical leg with a knurled outer surface, said alignment bars urged toward one another under pressure of a tension spring to contain, align, and firmly retain the pills or tablets in a straight line, and prevent them from slipping;

a removable cover member having a top end wall, opposed longitudinal side walls and longitudinally opposed rounded ends, and an open bottom end configured to be slidably received on said base member upper portion, a longitudinal cutting blade mounted on an underside of said top end wall along the center thereof and extending downwardly a distance therefrom terminating in a cutting edge; and a longitudinal retractable blade guard movably mounted beneath an underside of said cover member top end wall having a generally U-shaped transverse cross section and a central longitudinal slot extending along the center thereof, said blade guard spring biased downwardly by a pair of compression springs at each end to retractably cover said cutting edge of said cutting blade; wherein said cover member is slidably received on said base member upper portion and manually pressed straight downward relative thereto, said blade guard contacts the pills or tablets retained by said alignment bars and is retracted to expose said cutting edge and the cutting blade bisects all the pills or tablets in a single operation, and when downward force is reduced said cutting edge is surrounded by said blade guard to prevent injury.

2. The manually operated multiple pill or tablet splitter according to claim 1, wherein said cutting blade is secured in a central generally rectangular longitudinal cutting blade support formed on the underside of said cover member top end wall along the center thereof that extends downwardly a distance therefrom and its said cutting edge extending a short distance downwardly therefrom;

a pair of downwardly extending tubular posts are formed on the underside of said cover member top end wall, each disposed a distance outwardly from respective opposed ends of said blade support and extending downward a distance beyond said blade support;

said blade guard has a pair of holes therethrough disposed a distance outwardly from said central longitudinal slot near respective opposed ends thereof;

each said compression spring is received on the exterior of each of said tubular posts with opposed ends disposed between said underside of said the cover member top wall and a top side of said blade guard, and retained by a pair of headed screws having their shanks passing through said holes of said blade guard.

3. The manually operated multiple pill or tablet splitter according to claim 1, wherein said alignment bars are operatively connected together by a tension spring and rotor assembly disposed in said base member so as to move toward one another and away from one another simultaneously.

4. The manually operated multiple pill or tablet splitter according to claim 3, wherein a pair of depending tubular posts extend downward a distance from said the underside of said base member top end wall in longitudinally spaced relation, and a pair of diametrically opposed longitudinally spaced apart arcuate slots extend through said base member top end wall equidistant from each said depending tubular post, and said tension spring and rotor assembly comprises:

a rotor member rotatably mounted on each said depending tubular post, respectively, each rotor member having a flat disk-shaped main body portion, a central tubular member extending downwardly from the underside thereof with a central bore extending through said central tubular member and said main body portion, a pair of diametrically opposed smaller diameter tubular upper posts extending upwardly a distance from a top surface of said disk-shaped main body portion equidistant from said central bore of said rotor, and a smaller diameter tubular lower post extending downwardly a distance from an underside of said disk-shaped main body portion radially spaced from said central bore of said rotor, each of said smaller diameter tubular upper and lower posts having a central bore;

said central tubular member of each said rotor rotatably received on a respective said tubular post on said underside of said base member top end wall, and said smaller diameter tubular upper posts of each said rotor slidably received through respective said diametrically opposed longitudinally spaced apart arcuate slots extending through said base member top end wall;

said horizontal leg of each of said alignment bars having a hole therethrough near longitudinally opposed ends, and secured by a headed pin to a respective said smaller diameter tubular upper post of said rotor received through a respective said diametrically opposed longitudinally spaced apart arcuate slot extending through said base member top end wall;

said tension spring has one end connected to one said tubular post on said underside of said base member the top end wall by a headed pin, and the opposed end of said tension spring is connected to a said smaller diameter tubular lower post that extends downwardly from said underside of said disk-shaped main body of one said rotor by a headed pin; and the tension force of said tension spring pulls said alignment bars toward the center of said base member, and the alignment bars remain parallel to each other and equidistant from the centerline of the said base member.

* * * * *